United States Patent [19]

Luinstra

[11] 4,428,460

[45] Jan. 31, 1984

[54] LIFT CAR SUSPENSION

[75] Inventor: Marco F. Luinstra, Miranda, Australia

[73] Assignee: Elevators Pty. Limited, Waterloo, Australia

[21] Appl. No.: 197,257

[22] Filed: Oct. 15, 1980

[30] Foreign Application Priority Data

Oct. 15, 1979 [AU] Australia ..... PE0923

[51] Int. Cl.[3] ..... B66B 9/00

[52] U.S. Cl. ..... 187/1 R; 248/317

[58] Field of Search ..... 187/1 R; 105/453; 248/555, 554, 556, 581, 610, 163, 317

[56] References Cited

U.S. PATENT DOCUMENTS

| | | | |
|---|---|---|---|
| 2,524,413 | 10/1950 | Von Migula | 248/556 |
| 2,965,338 | 12/1960 | Mclean | 248/556 |
| 3,085,773 | 4/1963 | Anstrom et al. | 248/555 |
| 3,114,705 | 12/1963 | Pribonic et al. | 248/610 |
| 4,113,064 | 9/1978 | Shigeta et al. | 187/1 R |

FOREIGN PATENT DOCUMENTS

| | | | |
|---|---|---|---|
| 103111 | 6/1937 | Australia | 248/556 |
| 464496 | 6/1975 | Australia . | |
| 656019 | 3/1965 | Belgium | 187/1 R |
| 1431865 | 11/1968 | Fed. Rep. of Germany | 187/1 R |

*Primary Examiner*—Joseph J. Rolla
*Assistant Examiner*—Kenneth Noland
*Attorney, Agent, or Firm*—Owen, Wickersham & Erickson

[57] ABSTRACT

A lift car support apparatus providing relatively low natural frequencies of horizontal vibration of the car. A lift car is supported by a lift support member via suspension units. In each unit an intermediate member is pivotably connected to the lift support member. A single elongate member is fixedly connected to that intermediate member and pivotably connected to the underside of the lift car near its floor.

23 Claims, 9 Drawing Figures

LIFT CAR SUSPENSION

BACKGROUND OF THE INVENTION

This invention relates to an apparatus for supporting lift cars.

It is now well accepted that to achieve a good standard of comfort for the passengers of a high speed lift it is necessary to ensure that the lift car is appropriately suspended.

An often used technique for lift car suspension is to mount the car in a cage structure suspended by hoist ropes within a lift well and provided with wheels or rollers arranged to engage with rails fixed to the walls of the lift well.

To prevent the transmission to the car of shock and vibration generated in the cage as a result of its movement over imperfections in the rails, wind turbulence and rope vibration, rubber blocks have been used to mount the car within the cage.

This approach has met with a degree of success and is widely followed. However, the disadvantage of using such a rubber block system is that the natural frequency of horizontal vibration of the lift car mounted using such a system is higher than that which has been found to give better comfort to the passengers.

The present invention is a lift car suspension system based on the "Ball's-point" linkage a diagrammatic representation of which is illustrated in FIG. 1 annexed hereto and as hereinafter discussed.

BRIEF SUMMARY OF THE INVENTION

The invention may be broadly defined as an apparatus for supporting a lift car relative to a lift support member, the apparatus comprising a plurality of suspension units with each unit comprising:

an intermediate member, first connection means for pivotally connecting the lift car to the intermediate member, second connection means for pivotally connecting the intermediate member to the lift support member, wherein, when the unit is installed, the intermediate member is located outside a zone defined by horizontal planes respectively passing through the connection points of the first and second connection means to the lift car and the support member respectively, the relative dimensions of the first and second connection means and the positioning of the points of connection of said connection means to the lift car and the lift car support member being chosen so that the lift car supported with said apparatus has a relatively low natural frequency of oscillation in the horizontal direction compared with the value of 2 Hz.

Preferably resilient means are arranged to bias each suspension unit to a respective central position from which it may be displaced by horizontal perturbation of the lift support member.

Preferably, the lift car support member is arranged to be coupled to the base portion of a lift car supporting frame or cage which is arranged to contain the lift car and to move within a lift well.

Preferably the first connection means includes a single elongate member fixedly connected at one end portion to a plate comprising the intermediate member and pivotally connectable at the other end portion to the underside of the lift car in the region of the "floor" of the lift car.

Preferably the second connection means comprises a plurality of elongate members and each is pivotally connected at one end portion to the plate and pivotally connectable at the other end portion to the lift car support member.

Preferably the resilient means arranged to bias each suspension unit is located at the connection of said other end of the single elongate member to the underside of the floor of the lift car and is arranged to bias the single elongate member towards said central position.

A preferred apparatus for forming the connection of said other end of the single elongate member to the lift car is a universal bearing arranged to support in part at least the weight of the car, a resilient pad or pads being located about the bearing at a predetermined distance therefrom, a bearing support assembly being provided and being operable to engage the resilient pad or pads, the engagement providing the bias of the suspension unit towards its medial position.

Alternatively the resilient means arranged to centrally bias the suspension units may comprise a plurality of preloaded spring units mounted to interact between the lift car and the cage.

Preferably, the first and second connection means and the intermediate member of each suspension unit are arranged in the form of a uni-planar "Ball's-point" linkage, with the pivotal connection means only being operative about parallel axes; however, most preferably the second connection means comprises four elongate members, the second connection means, the first connection means and the intermediate member being dimensioned and arranged to provide what may be called a "two-dimensional" "Ball's-point" support structure with the pivotal connection means being universally pivotal at least over a predetermined range.

The four elongate members comprising said second connection means may comprise chains though preferably they comprise turnbuckles which provide for easy adjustment of their lengths.

Preferably, at least three such suspension units are used in the invention, although four such units may be used with one being located for convenience at each corner of the lift car floor.

Preferably, resilient elements such as rubber blocks are located at the top of the lift car to act between the car and the cage to steady the car within the cage during major perturbation of the cage.

The invention may be alternatively expressed as an apparatus for supporting a lift car relative to a lift support member, the apparatus comprising a plurality of suspension units, each comprising:

a "Ball's-point" type suspension linkage provided with a primary connection means to pivotally connect the linkage to the lift car, and a secondary connection means to pivotally connect the linkage to the lift support member, the components of the linkage being dimensioned and arranged such that a lift car when supported by the apparatus has a relatively low natural frequency of oscillation in the horizontal direction compared with the value of 2 Hz.

Preferably the apparatus is provided with resilient means to bias each suspension linkage towards a respective central position from which it may be displaced by horizontal perturbation of the lift support member.

Each "Ball's-point" type suspension linkage may simply comprise a classical "Ball's-point" unit being three elongate members pivotally connected end to end with single axis pivot joints and with the extreme ends of said connected members being pivotally secured by said secondary connection means to the lift support member at the same horizontal level, a fourth member being fixedly connected perpendicular to and medially of the middle member of the three with its end remote from said fixed connection secured by said primary connection means to the lift car, and the proportions of the members and the location of the points of connection being determined by the standard "Ball's-point" formula.

However, most preferably, the "Ball's-point" type linkage comprises:

an intermediate member, a first elongate member fixedly connected to the intermediate member and arranged for connection at its free end portion to the lift car with a universally pivotal joint comprising the primary connection means, second, third, fourth and fifth elongate members pivotally connected using universal joints to said intermediate member, the pivotal connections lying substantially in one plane on the intermediate member, and equidistant from the fixed connection of the first elongate member to the intermediate member, the pivotal connections being equally spaced about the fixed connection, the fixed connection being made so that the first elongate member extends generally perpendicularly from the plane, said second, third, fourth and fifth elongate members being arranged to be pivotally connected to the lift support member using universally pivotal joints comprising said second connection means, the points of connection also being in one plane and positoned so that in effect the "Ball's-point" type linkage in use comprises two classical "Ball's-point" linkages mounted at right angles with a common medial member in the form of said intermediate member, the proportions of the first, second, third, fourth and fifth members and the intermediate member, and the placement of the pivotal connections being determined by the classical "Ball's-point" formula.

Preferably, the resilient means are provided as part of the universally pivotal joint comprising the primary connection means, and comprise a resilient pad or pads located about the universal bearing and displaced a predetermined distance therefrom, a bearing support assembly being provided and being operable to engage the resilient pad or pads thereby providing the bias of the suspension unit to its central position.

Alternatively the resilient means arranged to centrally bias the suspension linkages comprises a plurality of preloaded spring units mounted to interact between the lift car and the cage.

Preferably, the lift car support member is coupled to the base portion of a lift car supporting frame or cage which is arranged to contain the lift car and to move within a lift well.

Preferably at least three such suspension units are used in the apparatus, although conveniently four such units may be used, with one being located for convenience at each corner of the lift car floor.

Preferably resilient members such as rubber blocks are located at the top of the lift car to act between the car and the cage to steady the car within the cage during major perturbation of the frame.

Another aspect of the invention relates to the means for connection of the suspension units referred to above to the lift cars.

Preferably, this connection may be effected by the use of a universal, pivoting load supporting bearing which is mounted on a suspension unit to enable its connection to the floor of the lift car. Resilient means are located about the bearing at positions displaced from its load bearing centre. A bearing support assembly which is provided is operable to engage the resilient means when the bearing is displaced from its medial position, thus providing a force operable to restore the bearing to its medial position.

The advantages attained in using apparatus embodying the invention are as follows:

The apparatus may have a simple configuration which allows easy conversion of presently installed lifts. The apparatus may allow for movement of lift cars in the horizontal direction without changing the height of the floor of the lift in relation to the lift cage. Finally, the present invention allows the supporting of lift cars with a relatively low natural frequency thus giving a more comfortable ride to the occupants of the lifts to which the invention is fitted.

BRIEF DESCRIPTION OF THE DRAWINGS

A preferred form of the invention will now be described with reference to the accompanying drawings wherein.

DETAILED DESCRIPTION

Figure 1:
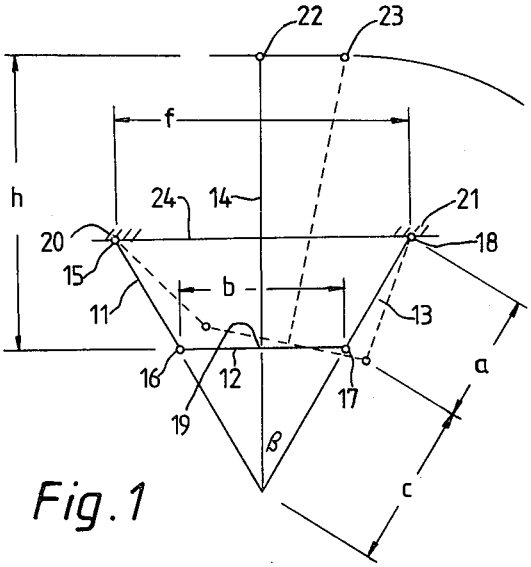
FIG. 1 is a diagrammatic representation of a "Balls-point" linkage.

Briefly, the "Balls-point" linkage depicted in FIG. 1 comprises linkage members 11, 12, 13 and 14 located in a vertical plane in mutually engaging relationship using pivot joints 16 and 17 and fixed joint 19, while members 11 and 13 are pivotally connected at pivot joints 15 and 18 to fixed points 20 and 21.

The dimensions of the linkage elements are not critical; however, to achieve the desired effect, the length of member 14 should be made equal to or slightly smaller than:

$$\frac{c\left(\frac{c}{a} + \sin^2\beta\right)}{\cos\beta}$$

where $c = \frac{ab}{f - b}$

-continued $$\beta = \arcsin \frac{(f-b)}{2a}$$

The most significant characteristic of this linkage is defined as follows. Where the linkage is dimensioned according to the constraint discussed above, the locus of the points traced out in the plane of the linkage by point 22 is rectilinear and parallel to the line 24 linking the pivot axis of pivot joints 15 and 18 while-ever the members 11 and 13 do not move more than 13½° from a medial position. The medial position is defined as being the position of the members when member 12 is parallel to the line 24.

This characteristic has been found to be very useful for providing a suspension system with a substantially zero natural frequency of vibration along one axis in the horizontal plane.

Such a suspension may be effected by locating pivot points 15 and 18 in a horizontal plane, the linkage members in a vertical plane and the centre of mass of the object to be supported at point 22. Operation of the linkage through movement of the mass in the horizontal plane and in the plane of the linkage does not create a restorative force because the linkage itself does not at any time provide a force with a horizontal component while-ever the linkage is operated within the range of 13½° as considered above.

If however, member 14 is longer than the length specified above, then a mass connected to the longer member no longer travels on a rectilinear path but rather it moves on an arcuate path which is concave downwards. Thus, the linkage in that case is unstable and tends to "fall away" from the medial position. Alternatively, if member 14 is shorter than the length specified above, then the suspension system is quite stable since a mass connected to the end of the shorter member moves along an arcuate path which is concave up and therefore whenever the linkage is displaced from its medial position it is subject to a restoring force acting to return it to its medial position.

Figure 2:
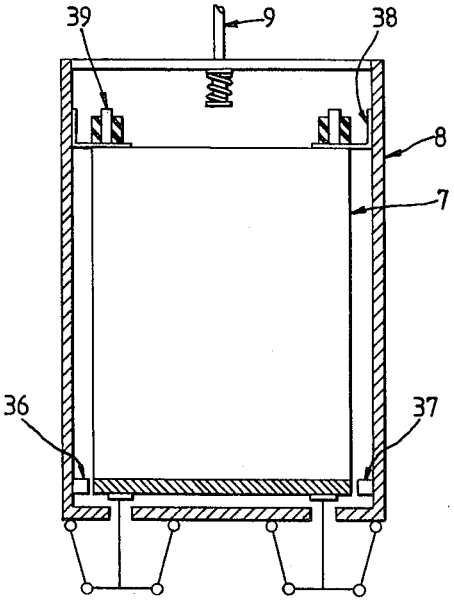
FIG. 2 is a diagrammatic elevation view representing a lift car supported using the apparatus of the invention.
Figure 4:
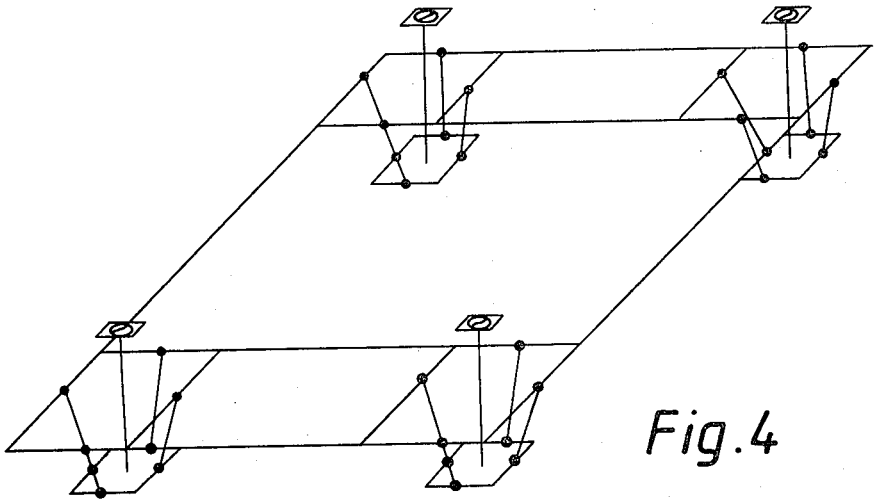
FIG. 4 shows a perspective view of the base of a lift cage provided with suspension units of the invention.
Figure 5:
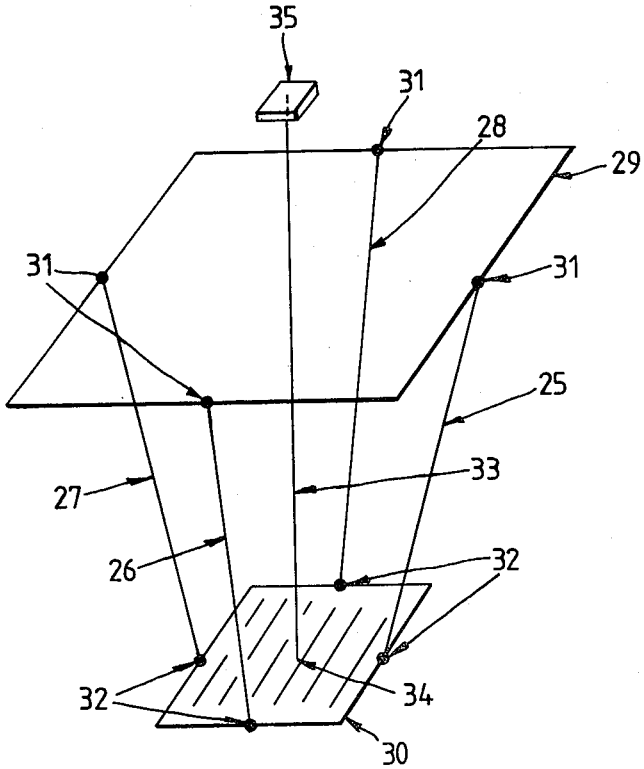
FIG. 5 shows a perspective view of a preferred form of the suspension units.

Referring now to FIG. 2 there is shown a lift car 7 supported within a lift cage 8 which is in turn suspended by a hoist rope 9. In this preferred form of the invention it is seen (FIG. 4) that there are four suspension units comprising the suspension apparatus of the lift car and each unit comprises what may be called a two-dimensional "Balls-point" suspension linkage (FIG. 5).

Each of the suspension units is identical hence only one of the suspension units need be described. Turnbuckles 25, 26, 27 and 28 are pivotally connected to the cage floor 29 and metal plate 30 at universal pivot points 31 and 32.

A support rod 33 is bolted or welded to the metal plate 30 at one end 34 and the other end is secured to the underside of the floor of the lift car via connecting means illustrated as Block 35. This connection means will be discussed in more detail with the assistance of FIGS. 6, 7 and 8.

Brackets 40 and rubber blocks 41 (FIG. 3) are connected to the floor of the lift car and the lift cage respectively, to prevent any large movement of the car within the cage.

Rubber blocks 36 and 37 are also provided to absorb any large perturbations of the lift cage generated at floor level during its movement through the lift well.

Stabilising brackets 38 are used in conjunction with rubber blocks 39 to maintain the stability of the top of the lift car during movement of the car through the lift well.

Figure 6:
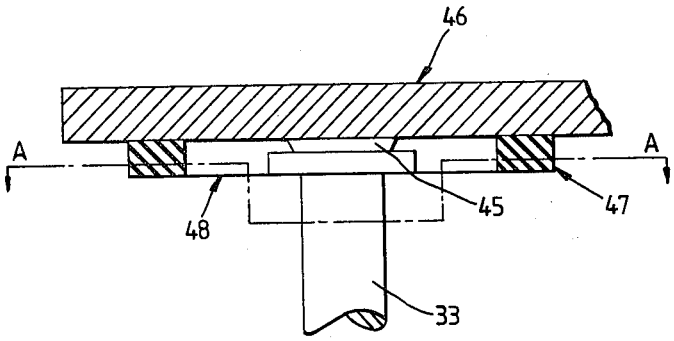
FIG. 6 shows an apparatus for mounting a lift car on the suspension units of FIG. 4.
Figure 7:
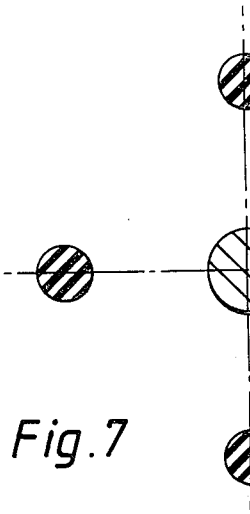
FIG. 7 shows a partial sectional view of the apparatus of FIG. 6 showing one of the preferred forms in which the resilient blocks of the apparatus may be included.
Figure 8:
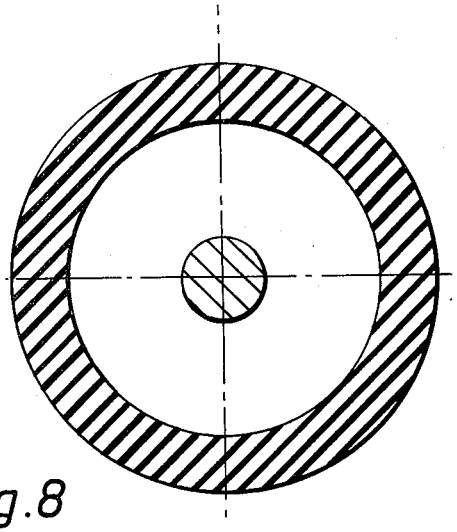
FIG. 8 shows a further sectional view of the apparatus of FIG. 6 showing an alternative form of resilient means which may be used as a part of the apparatus of FIG. 5.

FIG. 6 shows an apparatus useful for mounting a lift car on the suspension units described above. The apparatus includes a universal bearing 45 operable through about 7° from centre, located between the support rod 33 and the floor of the lift car 46. This bearing is designed to transfer the weight of the lift car to the suspension unit. Resilient blocks 47 of compressible rubber-like material with inherent damping qualities are located between the floor of the lift car and member 48, which is rigidly attached to the support rod 33. The spacing of the resilient blocks about the bearing may be done according to the configuration of FIG. 7 which is a sectional view of the blocks of FIG. 6 along section line A—A. Alternatively, a ring of resilient material may be used in place of the blocks (FIG. 8). The relative height of the surfaces bearing on the resilient blocks or ring are adjusted so that when the suspension rod is in its central position a predetermined amount of preload of the blocks or ring is provided.

Deflection of suspension unit 45 from its central position causes the application of a restoring force to the suspension unit by resilient material 47. This restoring force has been found to be important to the centralising of the lift car within the case since the "Ball's-point" suspension unit in the preferred form does not contribute in any substantial way to the horizontal positioning of the lift car within the cage.

Figure 3:
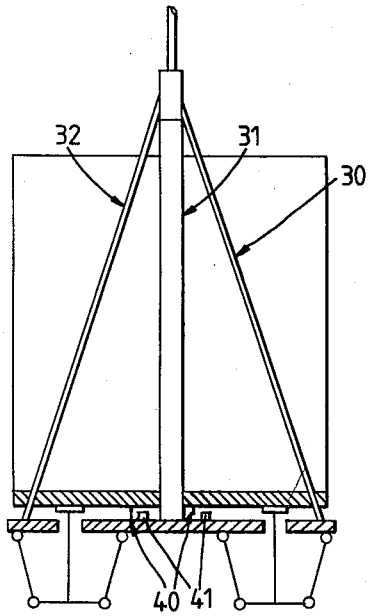
FIG. 3 is a diagrammatic end view of the lift car of FIG. 2.
Figure 9:
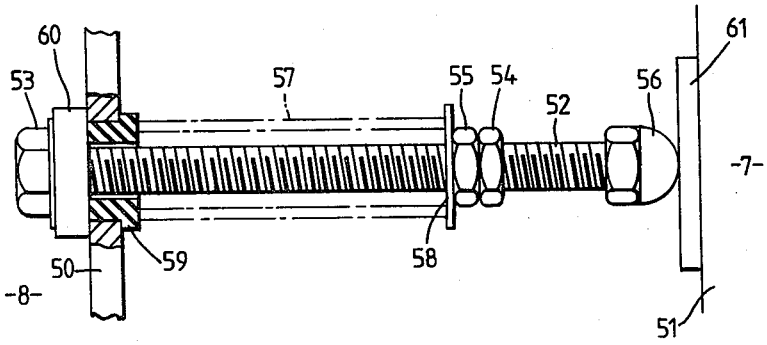
FIG. 9 shows an elevation view of a preloaded spring assembly useful in some embodiments of the invention.

FIG. 9 shows a preloaded spring assembly a number of which, in a preferred form of the invention, are positioned to operate between the lift car and the cage at respective positions similar to rubber blocks indicated at 41 on FIG. 3.

The spring assemblies may be adjusted and arranged to replace and provide a similar centralising effect to the lift car to that provided by resilient member 47 and the associated componentry shown in FIG. 6.

The spring assembly is shown mounted to portion 50 of the lift cage 9 and is in engagement with portion 51 of lift car 7. Each spring assembly comprises an elongate threaded bolt 52 provided with head 53. Three nuts 54, 55 and 56 are threaded onto the bolt in the configuration shown. In particular, round head nut 56 is selected to engage portion 51 of the lift car at plastics material bearing pad 61.

Spring 57 is mounted between a spring register 58 and a nylon bush 59 which are each mounted to bolt 52. The plastics bearing pad 62 and a rubber bush 60 are each selected and provided to reduce noise in the operation of the spring assembly.

A predetermined amount of pre-load is applied to spring 57 by appropriate positioning of nuts 54 and 55 on the bolt to ensure the required natural frequency of oscillation of the lift car is achieved.

I claim:

1. An apparatus for supporting a lift car relative to a lift support member, the apparatus comprising a plurality of suspension units with each unit comprising:

an intermediate member, first connection means for pivotally connecting the lift car to the intermediate member, comprising a single elongate member fixedly connected at one end portion to said intermediate member and pivotally connectable at the other end portion to the underside of the lift car in the region of the floor of the lift car, second connection means for pivotally connecting the intermediate member to the lift support member, wherein, when the unit is installed, the intermediate member is located outside a zone defined between horizontal planes respectively passing through the connection points of the first and second connection means to the lift car and the support member respectively, the relative dimensions of the first and second connection means and the positioning of the points of connection of said connection means to the lift car and the lift car support member being chosen so that the lift car supported with said apparatus has a relatively low natural frequency of oscillation in the horizontal direction compared with the value of 2 Hz.

2. An apparatus as claimed in claim 1 and comprising four said suspension units with one being located at each corner of the lift car floor.

3. An apparatus as claimed in claim 1 in which means are arranged to bias each suspension unit to a central position from which it may be displaced by horizontal perturbation of the lift support member.

4. An apparatus as claimed in claim 3 in which the lift car support member is arranged to be coupled to the base portion of a lift car supporting frame or cage which is in turn arranged to contain the lift car and to move within a lift well.

5. An apparatus as claimed in claim 4 in which said biasing means comprises resilient means arranged to centrally bias the suspension unit comprises a plurality of preloaded spring units mounted to interact between the lift car and the cage.

6. An apparatus as claimed in claim 4 in which resilient elements are located at the top of the lift car to act between the car and the lift support member to steady the car within the lift support member during major perturbations thereof.

7. An apparatus for supporting a lift car relative to a lift support member, the apparatus comprising a plurality of suspension units with each unit comprising:

an intermediate member, first connection means for pivotally connecting the lift car to the intermediate member, second connection means for pivotally connecting the intermediate member to the lift support member, wherein, when the unit is installed, the intermediate member is located outside a zone defined between horizontal planes respectively passing through the connection points of the first and second connection means to the lift car and the support member respectively, the relative dimensions of the first and second connection means and the positioning of the points of connection of said connection means to the lift car and the lift car support member being chosen so that the lift car supported with said apparatus has a relatively low natural frequency of oscillation in the horizontal direction compared with the value of 2 Hz, means for biasing each said suspension unit to a central position from which it may be displaced by horizontal perturbation of the lift support member, the lift car support member being arranged to be coupled to the base portion of a lift car supporting frame or cage which is in turn arranged to contain the lift car and to move within a lift well, the first connection means including a single elongate member fixedly connected at one end portion to a plate comprising the intermediate member and pivotally connectable at the other end portion to the underside of the lift car in the region of the "floor" of the lift car.

8. An apparatus as claimed in claim 7 in which the second connection means comprises a plurality of elongate members each of which is pivotally connected at one end portion to the plate and pivotally connectable at the other end portion to the lift car support member.

9. An apparatus as claimed in claim 8 in which said biasing means comprises resilient means arranged to bias the suspension unit is located at the connection of said other end of the single elongate member to the underside of the floor of the lift car and is arranged to bias the single elongate member towards a neutral position.

10. An apparatus as claimed in claim 9 in which the means for connection of said other end of the single elongate member to the lift car is a universal bearing arranged to support in part at least the weight of the car, a resilient pad or pads being located about the bearing at a predetermined distance therefrom, a bearing support assembly being provided and being operable to engage the resilient pad or pads the engagement providing the bias of the suspension unit towards it medial position.

11. Apparatus as claimed in claim 8, wherein two of said plurality of elongate members are each of length "a" and are located equally spaced on opposite sides of said single elongate member of length "h" of the first connection means, with the pivotal connections to the intermediate member being spaced apart by distance "b", said pivotal connections being equi-distant from the single elongate member, the pivotal connections for connection of said two elongate members to the lift support member being spaced apart by distance "f" and being substantially equi-distant from the single elongate member, the angle of each of said two elongate members when in a central position being $\beta$ to the vertical, the distance of each of said two elongate members from their respective connections with the intermediate member to the point of intersection with the vertical porjection of the single elongated member being distance "c", and said dimensions being in accordance with the following formula:

$$h = \frac{c\left(\frac{c}{a} + \sin^2\beta\right)}{\cos\beta}$$

where $c = \frac{ab}{f-b}$ and $$\beta = \arcsin\frac{(f-b)}{2a}.$$

12. Apparatus as claimed in claim 11, and said plurality of suspension units comprises four suspension units located at respective corner regions of a floor of said lift car.

13. Apparatus as claimed in claim 11, in which said second connection means comprises four elongate members arranged in two pairs, each pair being mounted as defined for said two of said elongate members in claim 22, and each of the connections at the respective ends at each of said four elongate members and the connection at the end of said single elongate member for connection to the lift car being a universal pivot.

14. An apparatus as claimed in claim 13 in which the elongate members comprising said second connection means comprise turnbuckles.

15. An apparatus for supporting a lift car relative to a lift support member, the apparatus comprising a plurality of suspension units each comprising:

a suspension linkage provided with a primary connection means adapted to pivotally connect the linkage to the lift car, an intermediate member to which the primary connection means is fixedly connected, and secondary connection means adapted to pivotally connect the linkage to the lift support member, the secondary connection means comprising two elongate members pivotally connected to the intermediate member at locations substantially equally spaced from and on opposite sides of said fixed connection of said primary connection means to the intermediate member and being adapted to be pivotally connected to said lift support member at respective locations equally spaced from and on opposite sides of the location at which the primary connection means is adapted to be pivotally connected to the lift car, and the intermediate member being constructed for location below the plane in which said two elongate members are adapted to be connected to the lift support member and below a horizontal plane through the location at which the primary connection means is adapted to be pivotally connected to the lift car, and the components of the linkage being dimensioned and arranged such that a lift car when supported by the apparatus has a relatively low natural frequency of oscillation in the horizontal direction compared with the value of 2 Hz.

16. An apparatus as claimed in claim 15, wherein the apparatus is provided with resilient means to bias each suspension unit towards a respective central position from which it may be displaced by horizontal perturbation of the lift support member.

17. An apparatus as claimed in claim 15, wherein the pivotal connections at the respective ends of said elongate members and the pivotal connection of the primary connection means to the lift car have substantially parallel axes of pivoting.

18. An apparatus as claimed in claim 15, wherein the suspension unit is dimensioned in accordance with the following formula:

$$h = \frac{c\left(\frac{c}{a} + \sin^2\beta\right)}{\cos\beta}$$

where $c = \frac{ab}{f-b}$ and $$\beta = \arc\sin\frac{(f-b)}{2a}$$

and a is the length of each elongate member b is the distance apart of the connections of the elongate members to the intermediate member c is the distance apart of the connections of the elongate members to the lift support member f is the distance, when the suspension unit is in a central position, along an imaginary line extending an elongate member to intercept a vertical line extending from the primary connection means and taken from the point of intersection to the point of pivotal connection of the elongate member with the intermediate member, h is the length of the primary connection means, and $\beta$ is the angle to the vertical of each elongate member.

19. An apparatus for supporting a lift car in a cage and comprising a plurality of suspension units for supporting the lift car on the cage, each suspension unit comprising:

an intermediate member;

a first elongate member fixedly connected to the intermediate member and arranged for connection at its free end portion to the lift car with a universally pivotal joint, second, third, fourth and fifth elongate members pivotally connected using universal joints to said intermediate member, the pivotal connections lying substantially in one plane on the intermediate member, and equidistant from the fixed connection of the first elongate member to the intermediate member, the pivotal connections being equally spaced about the fixed connection, the fixed connection being made so that the first elongate member extends generally perpendicularly from the plane, said second, third, fourth and fifth elongate members being arranged to be pivotally connected to the lift support member using universally pivotal joints located substantially in one plane and said second, third, fourth and fifth elongate members are arranged in two pairs respectively on opposite sides of the first elongate member and, in the central position of the suspension unit, lying in a common vertical plane with the first elongate member, each pair of elongate members being constructed relative to the intermediate member and the first elongate member in accordance with the following formula:

$$h = \frac{c\left(\frac{c}{a} + \sin^2\beta\right)}{\cos\beta}$$

where $c = \frac{ab}{f-b}$ and $$\beta = \arc\sin\frac{(f-b)}{2a}$$

and a is the length of each of said pair of elongate members b is the distance between the connections of said pair of elongate members to the intermediate member f is the distance between the point of connection of said pair of elongate members to the cage c is the length taken along an imaginery line projecting either of said elongate members from the point of connection with the intermediate member to intersection with a vertical line projecting the first elongate member, h is the length of the first elongate member, and $\beta$ is the angle to the vertical of each of the elongate members when in the central position.

20. An apparatus as claimed in claim 19 and wherein the resilient means are provided as part of each universally pivotal joint, and comprise a resilient pad means located about the universal bearing and displaced a predetermined distance therefrom, a bearing support assembly being provided and being operable to engage the resilient pad means thereby providing the bias of the suspension unit to its central position.

21. An apparatus as claimed in claim 19 in which resilient means are provided for biasing each suspension unit to a central position and said resilient means comprises a plurality of preloaded spring units mounted to interact between the lift car and said cage in which the lift car is mounted.

22. An apparatus as claimed in claim 19 wherein four said suspension units are used in the apparatus.

23. A lift car in combination with a cage and an apparatus for supporting a lift car as claimed in claim 19.

* * * * *